US006303232B1

(12) United States Patent
Mihoya et al.

(10) Patent No.: US 6,303,232 B1
(45) **Date of Patent: *Oct. 16, 2001**

(54) COATED PISTON AND SURFACE-TREATING FILM

(75) Inventors: Makoto Mihoya; Masaya Nomura; Shigehi Mitsuoka, all of Hamamatsu (JP)

(73) Assignee: Suzuki Motor Corporation (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 9 days.

(21) Appl. No.: 09/169,076

(22) Filed: Oct. 9, 1998

(30) Foreign Application Priority Data

Oct. 31, 1997 (JP) ..... 9-316363
Mar. 27, 1998 (JP) ..... 10-100320

(51) Int. Cl.[7] ..... B32B 9/00

(52) U.S. Cl. ..... 428/472.2; 148/273; 148/275; 148/279; 148/283

(58) Field of Search ..... 428/472.2; 148/247, 148/273, 275, 279, 283

(56) References Cited

U.S. PATENT DOCUMENTS 4,566,960 * 1/1986 Mohr ..... 204/129.75
4,650,525 3/1987 Yoshida et al. .
5,125,989 * 6/1992 Hallman ..... 148/247
5,584,946 * 12/1996 Karmaschek et al. ..... 148/247

FOREIGN PATENT DOCUMENTS

695182 * 7/1940 (DE) .
2445622A1 4/1976 (DE) .
3512442A1 10/1985 (DE) .
0020163386AA 6/1990 (JP) .
WO 85/05131 11/1985 (WO) .

* cited by examiner

*Primary Examiner*—John Sheehan
*Assistant Examiner*—Andrew L. Oltmans
(74) *Attorney, Agent, or Firm*—Myers Bigel Sibley & Sajovec, P.A.

(57) ABSTRACT

This invention relates to a surface treatment method comprising the steps of soaking aluminum or an aluminum alloy in a treating solution containing a fluorine compound and ammonium silicofluoride, and treating the aluminum or aluminum alloy in the treating solution at a temperature in the range of 70 to 100° C.; a piston having undergone such a surface treatment; and a piston coated with a film consisting of an Al-OH-F compound, as well as a sliding member in which its sliding surface and the like are coated with a slide film consisting, for example, of a compound of aluminum, fluorine and the hydroxyl group; and a surface-treating film for an aluminum alloy which is formed on a surface of aluminum or an aluminum alloy and consists of an aluminum fluoride hydroxide compound and silicon particles dispersed therein. The present invention can provide a surface treatment method which requires simple equipment, can reduce treating costs, and can yield aluminum or an aluminum alloy having excellent abrasion resistance, corrosion resistance and other properties, as well as sliding members and pistons having excellent abrasion resistance and other properties.

8 Claims, 7 Drawing Sheets

COATED PISTON AND SURFACE-TREATING FILM

FIELD OF THE INVENTION AND RELATED ART STATEMENT

This invention relates to a surface treatment method for aluminum or an aluminum alloy, and pistons surface-treated thereby, as well as a surface-treating film for aluminum or an aluminum alloy, and sliding members having a sliding surface coated therewith.

More particularly, this invention relates to a surface treatment method which requires simple equipment, can reduce treating costs, and can yield aluminum or an aluminum alloy having excellent abrasion resistance, corrosion resistance and other properties, as well as pistons having undergone a surface treatment according to this method. It also relates to a surface-treating film suitable for use on the sliding surfaces (or sleeve surfaces) of internal combustion engines and having excellent abrasion resistance, initial fitness, oil retention and other properties, and sliding members coated with such a slide film.

The Alumite treatment which has conventionally been employed is a method for anodizing aluminum in an acid bath to form a hard aluminum oxide film on the aluminum surface.

However, this method has the disadvantage that it requires equipment for electric power supply and that it involves a considerable cost because of a slow rate of film formation.

On the other hand, the skirt of an aluminum piston as an E/G component is plated with tin. Although the deposited tin film is soft and hence effective in bring about good initial fitness, it cannot be expected to have the effect of improving abrasion resistance.

OBJECT AND SUMMARY OF THE INVENTION

In view of the above-described problems of conventional surface treatment techniques, the present inventors made intensive investigations for the purpose of develop a surface treatment method which requires simple equipment, can reduce treating costs, and can form a uniform film having excellent corrosion resistance, abrasion resistance and other properties, as well as sliding members surface-treated by such a method.

As a result, the present inventors have found that the above-described problems can be solved by a surface treatment method comprising the steps of soaking aluminum or an aluminum alloy in a treating solution containing a fluorine compound and ammonium silicofluoride, and treating the aluminum or aluminum alloy in the treating solution at a temperature in the range of 70 to 100° C. Moreover, it has been found that the above-described problems can also be solved by coating the whole surface of a sliding member or the sliding surface thereof with a specific film consisting, for example, of a compound of aluminum, fluorine and the hydroxyl group, or by using a specific film formed on a surface of aluminum or an aluminum alloy and consisting of an aluminum fluoride hydroxide compound and silicon particles dispersed therein.

The present invention has been completed from this point of view.

That is, according to a first aspect of the present invention, there is provided a surface treatment method comprising the steps of soaking aluminum or an aluminum alloy in a treating solution (or a heated aqueous solution) containing a fluorine compound and ammonium silicofluoride, and treating the aluminum or aluminum alloy in the treating solution at a temperature in the range of 70 to 100° C. In this surface treatment method, the aforesaid treating solution (or heated aqueous solution) preferably contains 0.1 to 20 parts by weight of the fluorine compound and 0.05 to 15 parts by weight of ammonium silicofluoride, per 100 parts by weight of water. As used herein, the term "fluorine compound" comprehends fluorine compounds other than ammonium silicofluoride [$(NH_4)_2SiF6$]. Among these compounds, silicofluorides are preferred and magnesium silicofluoride ($MgSiF_6 \cdot 6H_2O$) is especially preferred.

The present invention also provides a piston having undergone a surface treatment according to the above-described surface treatment method.

According to a second aspect of the present invention, there is provided a piston wherein a surface thereof is coated with a film consisting of an Al-OH-F compound or an $NH_4MgAlF_6$ compound, or both, and preferably its whole surface including the piston ring grooves, piston pin boss, skirt, piston head and internal piston surface is coated with the aforesaid film. In this piston, the thickness of the film consisting of an Al-OH-F compound or the like is preferably in the range of 1 to 10 $\mu$m.

According to a third aspect of the present invention, there is provided a sliding member made of a base metal comprising aluminum or an aluminum alloy, wherein the whole surface of the sliding member or the sliding surface thereof is coated with a slide film which comprises a film consisting of a compound of aluminum, fluorine and the hydroxyl group, a film consisting of a hydrate of the compound, a film consisting of an $NH_4MgAlF_6$ compound, or a film consisting of a mixture of these compounds, has a cubic crystal structure, and shows no crystalline orientation. Moreover, there is also provided a sliding member wherein the whole surface of the sliding member or the sliding surface thereof is coated with a slide film which has a thickness of 1 to 100 $\mu$m and consists of a plurality of aggregates having a size of 1 to 100 $\mu$m, each aggregate being formed of microcrystals having a size of 1 $\mu$m or less.

According to a fourth aspect of the present invention, there is provided a surface-treating film for an aluminum alloy wherein the surface-treating film is a film formed on a surface of aluminum or an aluminum alloy and consisting of an aluminum fluoride hydroxide compound or an $NH_4MgAlF_6$ compound, or both, and silicon particles dispersed therein, the content of silicon particles dispersed in the film is in the range of 1 to 24% by weight and preferably 6 to 24% by weight, and the content of silicon in the aluminum alloy is in the range of 4 to 24% by weight and preferably 7 to 24% by weight.

Figure 1:
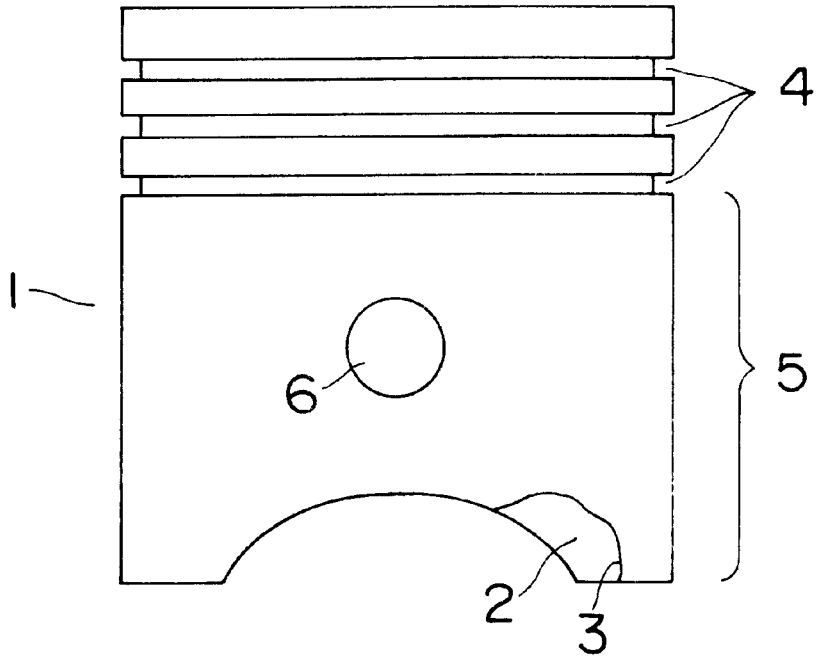
FIG. 1 is a schematic illustration of a piston in accordance with the present invention.

The reference numerals given in these views are defined as follows: 1, piston; 2, base metal; 3, slide film; 4, ring groove; 5, skirt; 6, pin hole; 7, microscrystal; 8, aggregate of microcrystals; 9, silicon; 10, aluminum alloy; 11, surface-treating film.

DETAILED DESCRIPTION OF PREFERRED EMBODIMENTS

First, the surface treatment method in accordance with the first aspect of the present invention is described below.

The surface treatment method of the present invention comprises the steps of soaking aluminum or an aluminum alloy in a treating solution (i.e., a heated aqueous solution) containing a fluorine compound and ammonium silicofluoride, and treating the aluminum or aluminum alloy in the treating solution at a temperature in the range of 70 to 100° C.

The treating solution used in the present invention contains a fluorine compound and ammonium silicofluoride [$(NH_4)_2SiF_6$]. As used herein, the term "fluorine compound" comprehends fluorine compounds other than ammonium silicofluoride.

Accordingly, the fluorine compounds which can be used in the treating solution of the present invention include various fluorine-containing compounds, except ammonium silicofluoride. Specific examples thereof include silicofluorides such as magnesium silicofluoride ($MgSiF_6 \cdot 6H_2O$), zinc silicofluoride ($ZnSiF_6 \cdot 6H_2O$), potassium silicofluoride ($K_2SiF_6$), sodium silicofluoride ($Na_2SiF_6$) and manganese silicofluoride ($MnSiF_6 \cdot 6H_2O$); borofluorides; and fluorides such as zirconium fluoride and titanium fluoride. Among these fluorine-containing compounds, silicofluorides are preferred, and magnesium silicofluoride, manganese silicofluoride and the like are especially preferred.

The treating solution used in the present invention preferably contains 0.1 to 20 parts by weight, more preferably 0.2 to 15 parts by weight, of the fluorine compound and 0.05 to 15 parts by weight, more preferably 0.1 to 10 parts by weight, of ammonium silicofluoride [$(NH_4)_2SiF_6$], per 100 parts by weight of water. This treating solution makes it possible to form a film having better uniformity and corrosion resistance on the surface of the aluminum alloy.

If the amount of the fluorine compound is less than 0.1 part by weight or the amount of ammonium silicofluoride is less than 0.05 part by weight in the treating solution used in the present invention, the reaction will be retarded to extend the treating time to an undue extent.

On the other hand, if the amount of the fluorine compound is greater than 20 parts by weight or the amount of ammonium silicofluoride is greater than 15 parts by weight, it may be difficult to dissolve the compound(s).

The surface treatment method of the present invention is applied to aluminum or an aluminum alloy. Specific examples thereof include pure aluminum, flattened aluminum materials, cast aluminum and die casting aluminum materials. This surface treatment method is applicable to a wide variety of aluminum materials and has the effect of improving abrasion resistance, corrosion resistance and other properties as a result of the surface treatment.

The pretreatment of a material to be surface-treated may be carried out simply by removing contaminants (e.g., oil) attached thereto. However, its surface treatment is preferably carried out after the material is subjected to alkali etching with sodium hydroxide or the like, and acid cleaning.

According to the surface treatment method of the present invention, the aluminum or aluminum alloy to be surface-treated is soaked in the aforesaid treating solution (or heated aqueous solution).

Then the temperature of the treating solution in which the aluminum or aluminum alloy is treated is usually in the range of 70 to 100° C., preferably 75 to 99° C., and more preferably 80 to 98° C. If the temperature of the treating solution is lower than 70° C., the reaction will be retarded to extend the treating time to an undue extent. On the other hand, if the temperature of the treating solution is higher than 100° C., evaporation of the treating solution will be increased to an undue extent.

As to the treating time, it is sufficient for surface-treating purposes to treat the material in the treating solution for a period of about 2 minutes, because the film-forming reaction is completed in a period of about 1 minute. It is to be understood that, once a film is formed, the material may be soaked in the treating solution for 30 minutes or more without any problem, because this film has a protective effect.

The surface-treating film formed on aluminum or the like according to the above-described surface treatment method of the present invention has a protective effect and can hence improve the corrosion resistance of the aluminum base material. Moreover, the surface-treating film so formed has excellent abrasion resistance.

On the other hand, since the surface treatment method of the present invention requires no equipment of electric power supply, the equipment can be simplified and this is very advantageous from the viewpoint of cost. Moreover, as compared with conventional surface treatment techniques, the surface treatment method of the present invention give a faster rate of film formation on the surfaces of aluminum or the like, and hence has higher productivity.

Next, the piston in accordance with the second aspect of the present invention is described below.

The piston of the present invention is a piston having undergone a surface treatment according to a surface treatment method which comprises the steps of providing a treating solution (or a heated aqueous solution) containing a fluorine compound (e.g., a silicofluoride) and ammonium silicofluoride, and soaking aluminum or an aluminum alloy in the treating solution at a temperature in the range of 70 to 100° C. In this method, it is preferable that the aforesaid treating solution contains 0.1 to 20 parts by weight of the fluorine compound and 0.05 to 15 parts by weight of ammonium silicofluoride, per 100 parts by weight of water.

Before forming a film according to the above-described surface treatment method, the piston of the present invention is cleaned with an organic solvent, a degreasing agent and the like. The present invention may be applied to a wide variety of common engine pistons made of aluminum alloy.

The cleaned engine piston is soaked in the treating solution according to the above-described surface treatment method. Thus, a film consisting of an Al—OH—F compound or an $NH_4MgAlF_6$ compound, or both, is formed on the piston surface. During this treatment, in the case, for example, of an Al—OH—F compound, a slight amount of aluminum is dissolved from the surface of the piston made of aluminum. This aluminum reacts with fluorine radicals and hydroxyl groups present in the solution to form an Al—OH—F compound, which deposits on the piston surface. Alternatively, the piston of the present invention may be obtained by the deposition of an $NH_4MgAlF_6$ compound on the piston surface in the presence of magnesium, or by the deposition of both an Al—OH—F compound and an $NH_4MgAlF_6$ compound on the piston surface.

As to the treating time, it is sufficient for surface-treating purposes to soak the piston in the treating solution for a period of about 2 minutes and preferably 3 to 10 minutes, because the film-forming reaction is completed in a period of about 1 minute similarly to the above-described surface treatment method. It is to be understood that, once a film is formed, the piston may be soaked in the treating solution for 30 minutes or more without any problem, because this film has a protective effect.

In the piston of the present invention which is obtained in the above-described manner, its surface is coated with a film consisting of an Al—OH—F compound or an $NH_4MgAlF_6$ compound, or both, and hence exhibits excellent surface properties. This film consisting of an Al—OH—F compound or the like can produce a beneficial effect even if it is formed on any of various parts such as the piston ring grooves, piston pin boss, skirt surface, piston head and internal piston surface. However, it is preferable that its whole surface including these parts is coated with the film.

The thickness of the film formed on the piston surface and consisting of an Al—OH—F compound or an $NH_4MgAlF_6$ compound, or both, is preferably in the range of 1 to 10 pm.

The above-described piston of the present invention is not so soft as conventional pistons plated, for example, with tin, but has excellent abrasion resistance and very good durability.

Next, the sliding member in accordance with the third aspect of the present invention is described below.

The sliding member of the present invention is made of a base metal comprising aluminum or an aluminum alloy, and the whole surface of the sliding member or the sliding surface thereof is coated with a slide film which comprises a film consisting of a compound of aluminum, fluorine and the hydroxyl group, a film consisting of a hydrate of the compound, a film consisting of an $NH_4MgAlF_6$ compound, or a film consisting of a mixture of these compounds, has a cubic crystal structure, and shows no crystalline orientation. Alternatively, the whole surface of the sliding member or the sliding surface thereof is coated with a slide film which has a thickness of 1 to 100 $\mu$m and consists of a plurality of aggregates having a size of 1 to 100 $\mu$m, each aggregate being formed of microcrystals having a size of 1 $\mu$m or less. Specific examples of the hydrate of the aforesaid Al—OH—F compound include $Al_2(OH)_{2.76}F_{3.24}\cdot H_2O$ and $AlF_{1.65}(OH)_{1.35}\cdot xH_2O$. This sliding member is more specifically described below with reference to FIG. 1.

Referring to FIG. 1, a piston 1 for use in an internal combustion engine, which is a sliding member, is made of a base metal comprising an aluminum alloy. The surface of the base metal is coated with a slide film 3 for improving its sliding characteristics. Its skirt 5 slides over the inner wall of a cylinder bore constituting the opposite member, its ring grooves 4 slide against piston rings, and its pin hole 6 slides over a piston pin.

By way of example, an Al—Si—Cu—Ni—Mg alloy or the like is used as base metal 2. Specific examples of the alloy include AC8A, AC8B, AC9A and AC9B.

Slide film 3 is formed on the surface of piston 1 by subjecting piston 1 to a chemical conversion treatment. This film 3 may comprise a film consisting of a compound of aluminum, fluorine (F) and the hydroxyl group (OH), or a film consisting of a hydrate of the compound, such as $Al_2(OH)_{2.76}F_{3.24}\cdot H_2O$ or $AlF_{1.65}(OH)_{1.35}\cdot xH_2O$. Moreover, film 3 may comprise a film consisting of an $NH_4MgAlF_6$ compound, or a film consisting of a mixture of the aforesaid Al—OH—F compound or a hydrate thereof, and the $NH_4MgAlF_6$ compound. Even though film 3 has any of these compositions, it has a cubic crystal structure and shows no crystalline orientation.

Figure 2:
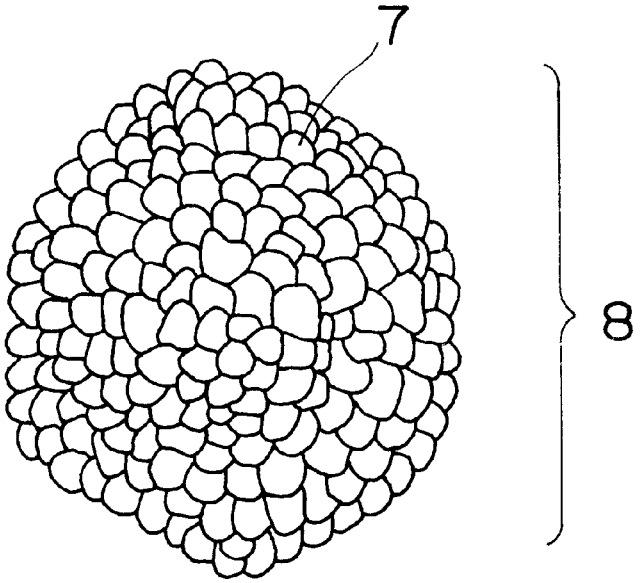
FIG. 2 is a schematic view illustrating microcrystals and an aggregate present on the base metal surface (sliding surface) treated in accordance with the present invention.

This slide film 3 consists of microcrystals 7 having a size of 1 $\mu$m or less. These microcrystals 7 gather together to form a plurality of aggregates 8 having a size of 1 to 100 $\mu$m, and these aggregates 8 coat the surface of the base metal to a thickness of 1 to 100 $\mu$m (FIG. 2). This slide film forms a new sliding surface.

These microcrystals 7 and aggregates 8 constituting slide film 3 causes an increase in the surface area of the sliding surface and hence an improvement in oil retention. Moreover, since aggregates 8 are preferentially worn away, the sliding surface exhibits good initial fitness. These improvements in wearing characteristics are effective in enhancing the durability of the sliding member, reducing friction, and improving fuel consumption.

Finally, the surface-treating film in accordance with the fourth aspect of the present invention is described below.

The surface-treating film for an aluminum alloy in accordance with the present invention is a film formed on a surface of aluminum or an aluminum alloy and consisting of an aluminum fluoride hydroxide compound or an $NH_4MgAlF_6$ compound, or both, and silicon particles dispersed therein. Moreover, the content of silicon particles dispersed in the film is in the range of 1 to 24% by weight and preferably 6 to 24% by weight, and the content of silicon in the aforesaid aluminum alloy is in the range of 4 to 24% by weight and preferably 7 to 24% by weight.

Figure 3:
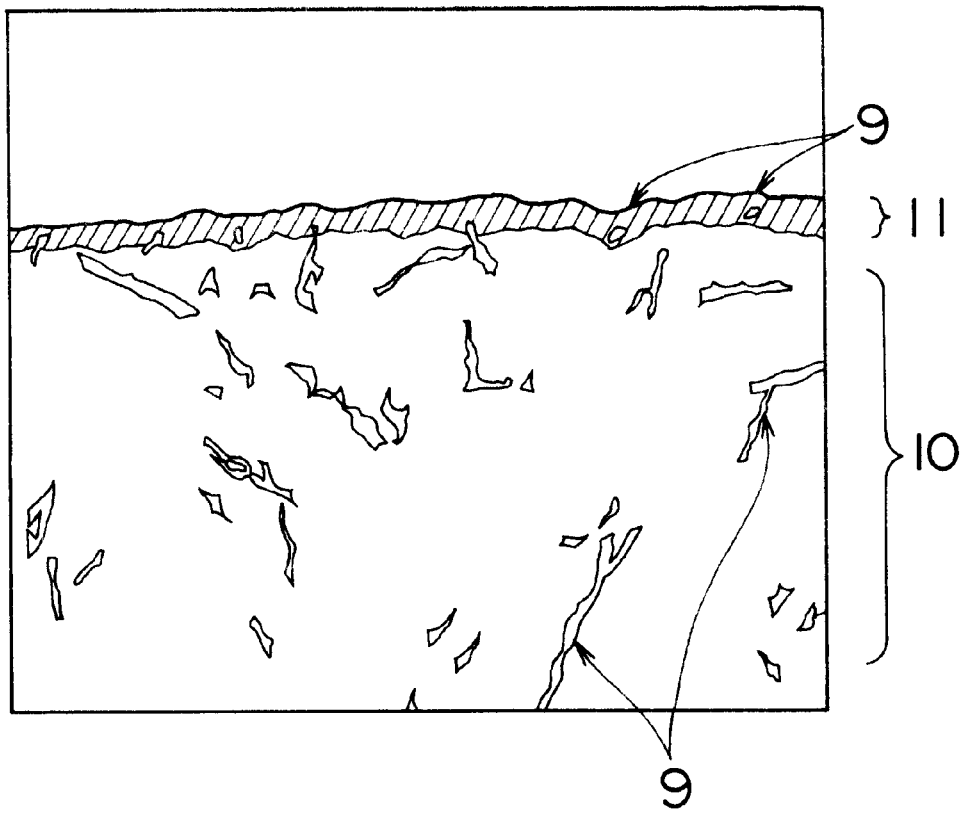
FIG. 3 is a schematic view illustrating a surface-treating film for aluminum alloys in accordance with the present invention.

The film structure obtained in accordance with the present invention is shown in FIG. 3. The aluminum alloy constituting the base metal contains 4 to 24% of silicon (Si), and eutectic Si or eutectic Si/initially crystallized Si is dispersed in the aluminum matrix. The surface of the aluminum alloy is coated with a film consisting of an aluminum fluoride hydroxide compound or an $NH_4MgAlF_6$ compound, or both, and Si particles similar to the eutectic Si or eutectic Si/initially crystallized Si dispersed in the aluminum alloy base metal are dispersed in this film.

The above-described structure of the surface-treating film in accordance with the present invention can be obtained in the following manner.

An aluminum alloy material containing 4 to 24% of silicon (Si) is degreased with an organic acid or a commercially available detergent, and then subjected to alkali etching and acid cleaning. Subsequently, this material is soaked in an aqueous silicofluoride solution heated to 70–100° C. (for example, a heated aqueous solution containing magnesium silicofluoride as a component and having a concentration of 0.1 to 20%) for a period of time ranging from about 30 seconds to about 5 minutes.

According to the above-described procedure, aluminum present in the surface of the aluminum alloy material is preferentially reacted and removed. At the same time, the dissolved aluminum, for example, reacts with fluorine radicals and hydroxyl groups present in the solution to form an aluminum fluoride hydroxide compound. This aluminum fluoride hydroxide compound deposits on the aluminum alloy surface while incorporating silicon particles which are hard to react and remove, and thereby forms a film thereon. Similarly, in the presence of magnesium in the alloy material or the like, a film consisting of an $NH_4MgAlF_6$ compound or a film consisting of both compounds may be formed on the aluminum alloy surface.

However, it is to be understood that, in the above-described procedure, degreasing, alkali etching and acid cleaning serve to clean the material and are not directly required to obtain the film structure of the present invention.

The surface treatment method for aluminum or an aluminum alloy in accordance with the present invention can provide a surface coating method which requires simple equipment, can reduce treating costs, and can yield aluminum or an aluminum alloy having excellent abrasion resistance, corrosion resistance and other properties.

That is, according to the present invention, the equipment can be simplified because the treating conditions are easy, and the resulting surface-coated aluminum or the like have excellent abrasion resistance and can reduce friction losses. Moreover, the film obtained by the method of the present invention has protective properties, so that it has a uniform film thickness over the whole surface of aluminum or the like without regard to the treating conditions, and shows little inequality in film thickness. Furthermore, the film thus obtained has excellent corrosion resistance and hence exhibits abrasion resistance even in a corrosive environment.

Moreover, the pistons having undergone a surface treatment according to the method of the present invention have excellent corrosion resistance, abrasion resistance and other properties. Accordingly, they have excellent durability and can be effectively used as pistons for various engines.

Furthermore, the sliding characteristics (e.g., abrasion resistance) and durability of engines, compressors and the like can be improved by coating the sliding surfaces (or sleeve surfaces) of their sliding members made of aluminum or an aluminum alloy according to the present invention. For example, if engine pistons are coated, improvements in abrasion resistance, initial fitness, oil retention and other properties can be achieved. This is effective in enhancing durability, reducing friction, and improving fuel consumption, and hence has a very important significance from an industrial point of view.

WORKING EXAMPLES

The present invention is more specifically explained with reference to the following examples. However, these examples are not to be construed to limit the scope of the present invention.

Example 1

0.67 part by weight of magnesium silicofluoride ($MgSiF_6 \cdot 6H_2O$) and 0.33 part by weight of ammonium silicofluoride [$(NH_4)_2SiF_6$] were dissolved in 100 parts by weight of water. This solution was heated to 90° C. and used as a treating solution.

An AC8A-T6 cast aluminum specimen having a diameter of 50 mm and a thickness of 5 mm was cleaned with an organic solvent and a degreasing agent, and then surface-treated by soaking it in the above treating solution. In the surface-treated cast aluminum specimen, a film consisting of an Al—OH—F compound was formed on the surface thereof.

Figure 4:
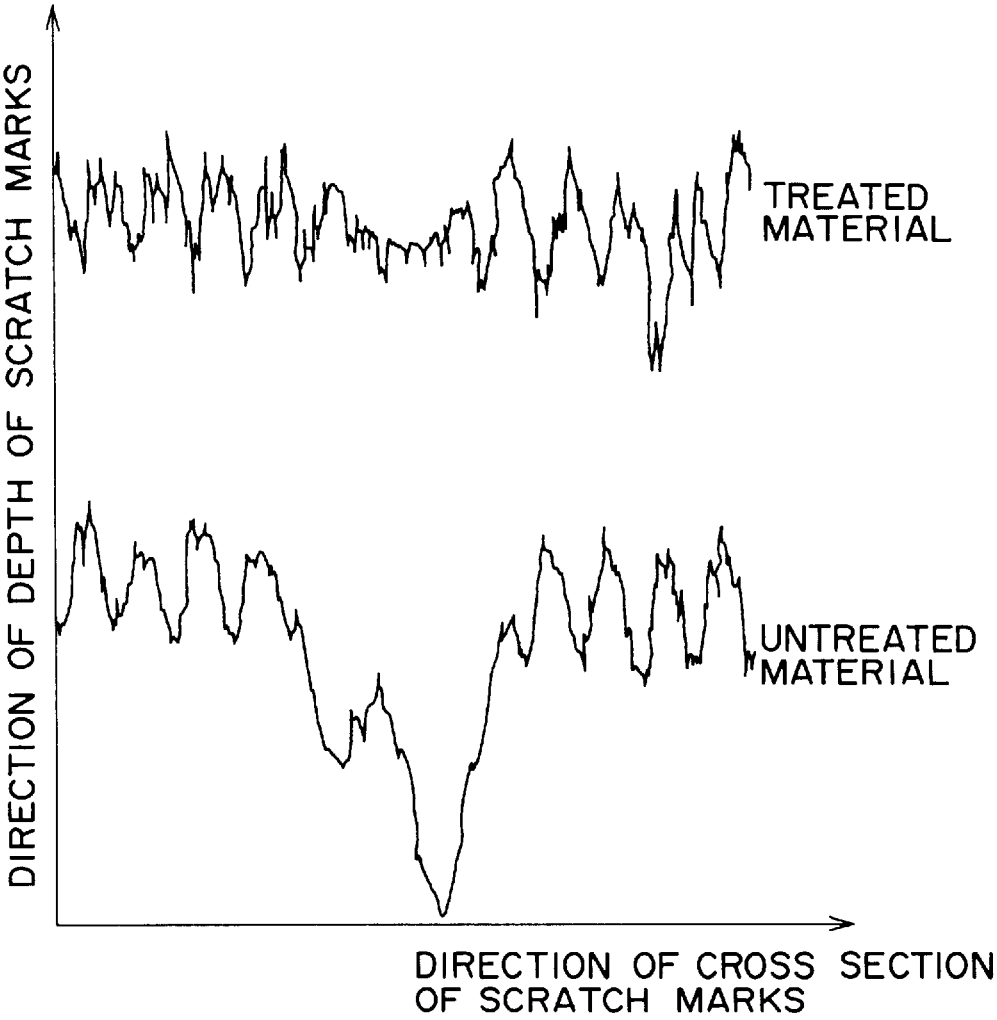
FIG. 4 is a diagrammatic view showing the cross-sectional shape of scratch marks as observed when a specimen in accordance with the present invention (a treated specimen) and a specimen having no film formed thereon (an untreated specimen) were subjected to a ball-on-disc abrasion test in Example 1.

With respect to the specimen having undergone the above-described surface treatment of the present invention, a ball-on-disk abrasion test was performed by using heat-treated SCM435 material as the opposite material. The cross-sectional shape (or profile) of the scratch marks so formed is shown in FIG. 4. Similarly, a specimen (of AC8A-T6 material) having no film formed thereon was subjected to a ball-on-disk abrasion test. The cross-sectional shape of the scratch marks so formed is also shown in FIG. 4.

As a result, the volumetric wear of the specimen having a film formed thereon according to the above-described surface treatment method was 1/20 of that of the specimen having no film formed thereon.

Moreover, the coefficient of friction of the aforesaid specimen having a film formed thereon was 0.09, and this value was over 20% smaller than that of the specimen having no film formed thereon.

Example 2

An engine piston (made of AC8A-T6) was cleaned with an organic solvent, a degreasing agent and the like, and then surface-treated by soaking it in the same treating solution as described above in Example 1 for 5 minutes. Thus, a film consisting of an Al—OH—F compound was formed on the surface of the piston.

Both the piston having undergone the above-described surface treatment of the present invention (i.e., the piston of Example 2) and a piston having undergone no surface treatment (i.e., an untreated piston) were assembled into an engine, and this engine was actually operated at full load.

After operation, each piston was removed and inspected for surface conditions. The inspection items included adhesion of aluminum to the rings, scoring of the pin boss surface, and scoring of the skirt surface.

The results thus obtained are shown in Table 1.

TABLE 1

| | Piston of Example 2 | Untreated piston |
|---|---|---|
| Adhesion of Al to rings | No | Yes |
| Scoring of pin boss surface | No | Yes |
| Scoring of skirt surface | No | Yes |

Consequently, the piston having undergone the surface treatment of the present invention showed improvements over the untreated piston with respect to all of the ring grooves, pin boss and skirt surface.

Example 3

AC8A and ADC12 materials were surface-treated in the same manner as described in Example 1. Then, their corrosion resistance was evaluated by salt water spray tests.

It can be seen from the results thus obtained that the surface-treating film of the present invention has a protective effect and the surface treatment method of the present invention can improve the corrosion resistance of the aluminum base metal.

Example 4

With respect to AC8A material surface-treated in the same manner as described in Example 1 (Example 4), ACBA material surface-treated with hard Alumite (hard Alumite-treated material), and untreated AC8A material (untreated material), their coefficients of friction under oil lubrication were measured by using SCM material as the opposite material.

The results thus obtained are shown in Table 2.

TABLE 2

| | Coefficient of friction |
|---|---|
| Example 4 | 0.09 |
| Hard Alumite-treated material | 0.13 |
| Untreated material | 0.12 |

It can be seen from these results that the piston of the present invention has a reduced coefficient of friction.

Example 5

A piston 1 made of a base metal comprising an aluminum alloy (AC8A material) was subjected to a pretreatment (see FIG. 1). This pretreatment comprised a procedure commonly employed in the plating of aluminum alloys, and included the following steps.

Degreasing→Alkali etching→Acid cleaning

After this pretreatment, piston 1 was subjected to a chemical conversion treatment. The conditions employed for this chemical conversion treatment are shown below.

A treating solution containing a 2:1 mixture of $MgSiF_6 \cdot 6H_2O$ and $(NH_4)_2SiF_6$ in an amount of 20-50 g per liter was heated to 90° C. As soon as the treating solution became turbid, piston 1 was soaked therein for 5 minutes.

As a result of this chemical conversion treatment, a slide film 3 was formed on the surface of piston 1.

Figure 5:
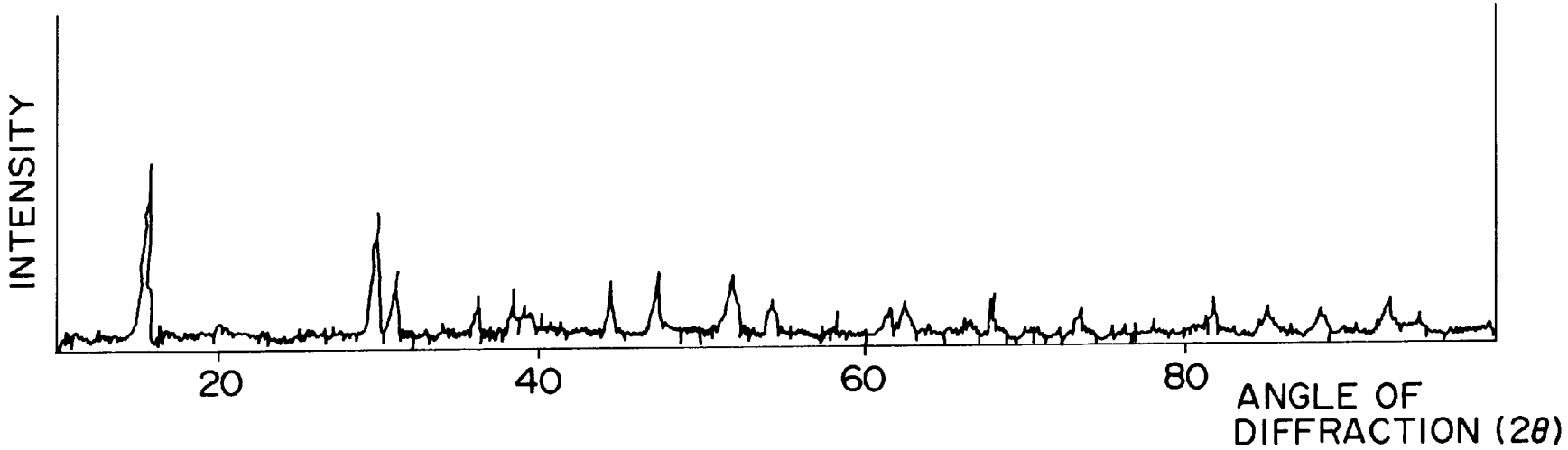
FIG. 5 is a diagrammatic view showing the typical structure of a surface obtained by the surface treatment method of the present invention.

FIG. 5 is a diagram used for reference in considering the film of the present invention singly in X-ray diffraction spectra. In this diagram, peaks arising from aluminum and silicon present in the base metal have been removed from the obtained data.

Figure 6:
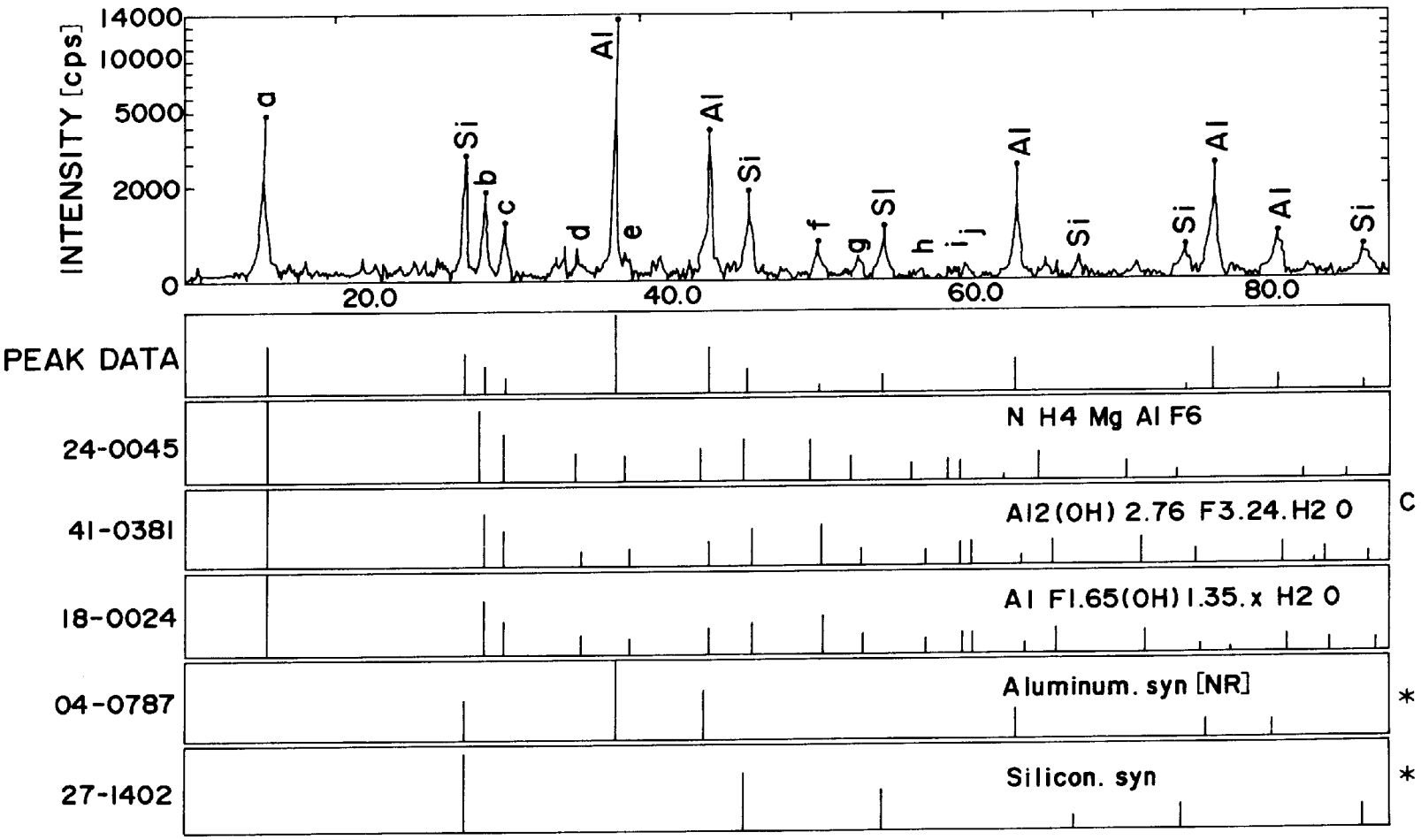
FIG. 6 is an X-ray diffraction diagram of a slide film coating a sliding member in accordance with the present invention.

FIG. 6 is an X-ray diffraction diagram recorded with piston 1 having slide film 3. It can be seen from FIG. 6 that slide film 3 is composed of $Al_2(OH)_{2.76}F_{3.24} \cdot H_2O$, $AlF_{1.65}(OH)_{1.35} \cdot xH_2O$ and $NH_4MgAlF_6$. However, this X-ray diffraction diagram includes both the X-ray diffraction spectrum of slide film 3 and the X-ray diffraction spectrum of aluminum (Al) constituting base metal 2 and silicon (Si) contained therein. Moreover, this X-ray diffraction diagram reveals that slide film 3 shows no crystalline orientation.

The Miller indices corresponding to peaks a to j shown in FIG. 6 were as follows.

a (1,1,1), b (3,1,1), c (2,2,2), d (4,0,0), e (3,3,1), f (4,4,0), g (5,3,1), h (6,2,0), i (5,3,3), j (6,2,2).

Figure 7:
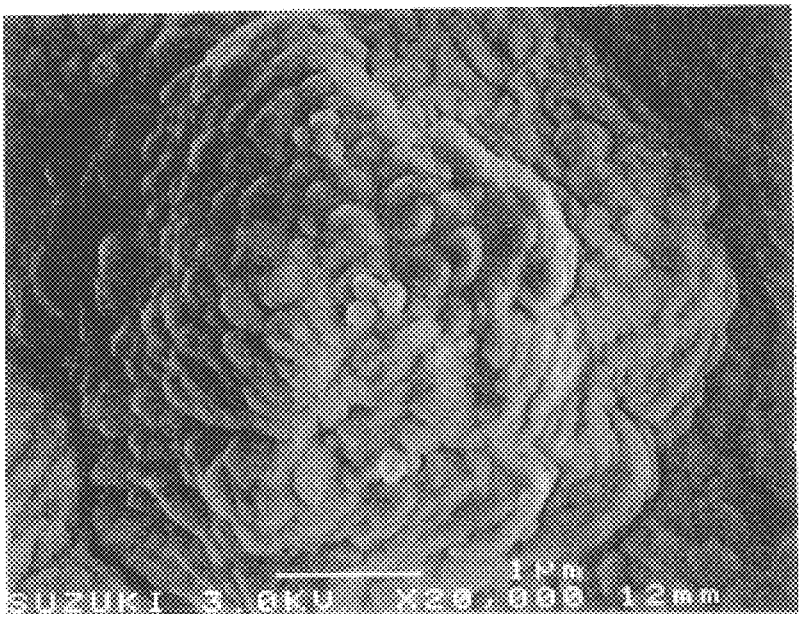
FIG. 7 is an electron micrograph (20,000X magnification) of a slide film coating a sliding member in accordance with 0 the present invention.
Figure 8:
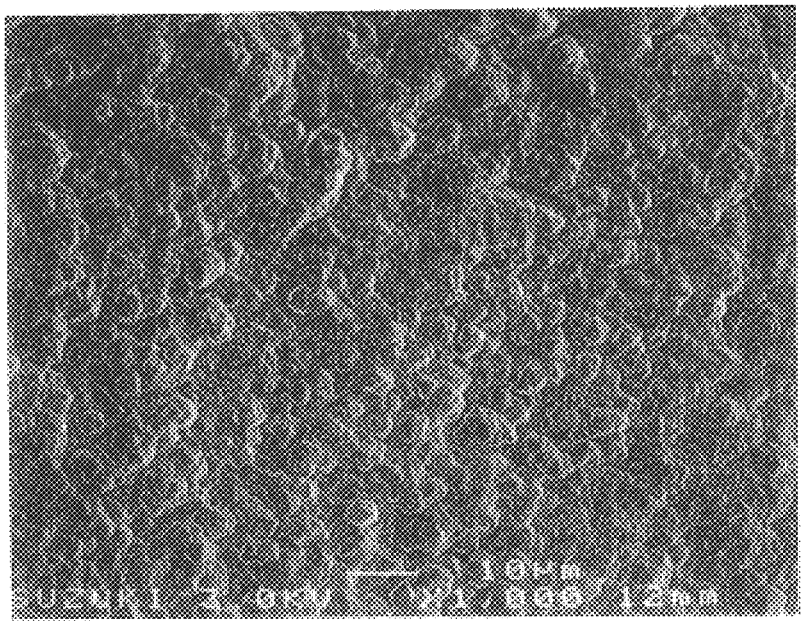
FIG. 8 is an electron micrograph (1,000X magnification) of the slide film shown in FIG. 7.

FIGS. 7 and 8 are electron micrographs of sliding surface 10 of slide film 3, and FIG. 2 is a schematic view corresponding to FIG. 7. It can be seen from FIGS. 2 and 7 that slide film 3 consists of microcrystals 7 and these microcrystals form an aggregate 8. Moreover, it can be seen from FIG. 8 that a plurality of aggregates 8 covers the surface of base metal 2 and form slide film 3.

Figure 9:
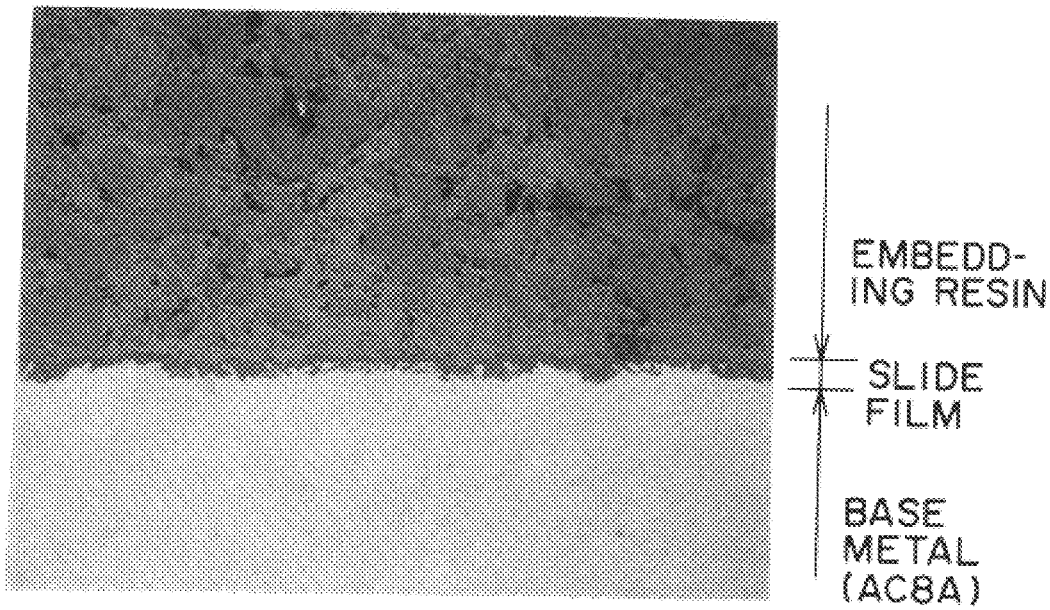
FIG. 9 is a photomicrograph (400X magnification) of a section of the slide film shown in FIG. 7.

FIG. 9 is a photomicrograph of a cross section of slide film 3 formed on base metal 2 comprising an aluminum alloy (AC8A material). The manner in which slide film 3 coats the base metal surface can be seen from FIG. 9. As shown in this photomicrograph, some of the silicon (Si) particles contained in base metal (AC8A material) 2 are incorporated into slide film 3. This is due to the fact that silicon particles contained in base metal (AC8A material) 2 remained on the base metal surface and were incorporated into slide film 3 formed in the chemical conversion treatment step.

Example 6

Six aluminum alloys having different silicon (Si) contents were degreased and then subjected to alkali etching and acid cleaning. Subsequently, each aluminum alloy was soaked in a heated aqueous silicofluoride solution containing magnesium silicofluoride. The aluminum alloy underwent a reaction in the solution and formed a film on the aluminum alloy surface while incorporating silicon particles thereinto. Thus, various specimens coated with films having different Si contents were obtained.

Using the specimens thus obtained, the abrasion resistance of the films was evaluated by means of a pin-on-disc type fraction-abrasion tester. The results of evaluation of abrasion resistance characterizing the films are shown in FIG. 10.

Figure 10:
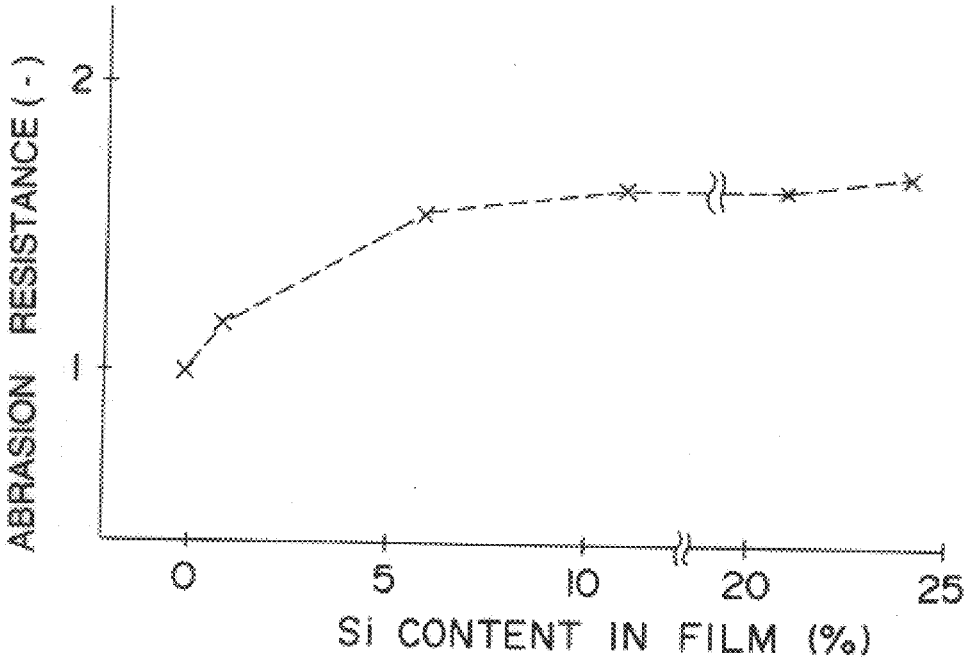
FIG. 10 is a graph showing the results of an abrasion resistance test carried out in Example 6.

In the tests shown in FIG. 10, the specimens were tested under oil lubrication by placing each specimen on the disc and using a cementation-hardened and tempered SCM420 pin as the opposite material. The test results were compared by expressing them in terms of volumetric wear.

When compared with the specimen containing no silicon (Si) in the film, even the specimen having a Si content of about 1% showed an improvement in abrasion resistance. The specimens having a Si content of 6% or greater were found to show a marked improvement in abrasion resistance.

We claim

1. A piston having a surface coated with an abrasion resistant film comprising an $NH_4MgAlF_6$ compound or an $NH_4MgAlF_6$, compound in combination with an Al—OH—F compound.

2. A piston as claimed in claim 1 wherein its whole surface including the piston ring grooves, piston pin boss, skirt, piston head and internal piston surface is coated with the abrasion resistant film comprising an $NH_4MgAlF_6$ compound or an $NH_4MgAlF_6$ compound in combination with an Al—OH—F compound.

3. A piston as claimed in claim 1 or 2 wherein the thickness of the abrasion resistant film comprising an $NH_4MgAlF_6$ compound or an $NH_4MgAlF_6$ compound in combination with an Al—OH—F compound is in the range of 1 to 10 $\mu$m.

4. A surface-treating film for an aluminum alloy wherein said surface-treating film is an abrasion resistant film formed on a surface of an aluminum alloy and wherein said surface-treating film comprises an $NH_4MgAlF_6$ compound or an $NH_4MgAlF_6$ compound in combination with an Al—OH—F compound and silicon particles dispersed therein, the content of silicon particles dispersed in the film is in the range of 1 to 24% by weight, and the content of silicon in the aluminum alloy is in the range of4 to 24% by weight.

5. A piston having an abrasion resistant coating comprising an $NH_4MgAlF_6$ compound or an $NH_4MgAlF_6$ compound in combination with an Al—OH—F compound, said abrasion resistant coating formed by a surface treatment method comprising the steps of soaking aluminum or an aluminum alloy in a treating solution containing magnesium silicofluoride ($MgSiF_6 \cdot 6H_2O$) and ammonium silicofluoride, and treating the aluminum or aluminum alloy in the treating solution at a temperature in the range of 70 to 100° C.

6. A piston as claimed in claim 5 wherein the treating solution contains 0.1 to 20 parts by weight of the magnesium silicofluoride ($MgSiF_6 \cdot 6H_2O$) and 0.05 to 15 parts by weight of ammonium silicofluoride, per 100 parts by weight of water.

7. A piston as claimed in claim 1 wherein the abrasion resistant film has a thickness of 1 to 100 $\mu$m and comprises a plurality of aggregates having a size of 1 to 100 $\mu$m, each aggregate being formed of microcrystals having a size of 1 $\mu$m or less.

8. A piston as claimed in claim 2 wherein the abrasion resistant film has a cubic crystal structure, and shows no crystalline orientation.

* * * * *

UNITED STATES PATENT AND TRADEMARK OFFICE

CERTIFICATE OF CORRECTION

PATENT NO. : 6,303,232 B1
DATED : October 16, 2001
INVENTOR(S) : Mihoya et al.

It is certified that error appears in the above-identified patent and that said Letters Patent is hereby corrected as shown below:

Column 10,
Line 56, change “compound” to -- compound, --.

Signed and Sealed this

Twenty-ninth Day of June, 2004

JON W. DUDAS
*Acting Director of the United States Patent and Trademark Office*